US005150164A

United States Patent [19]

Shea

[11] Patent Number: 5,150,164

[45] Date of Patent: Sep. 22, 1992

[54] TRANSFER APPARATUS

[75] Inventor: Robert H. Shea, Victor, N.Y.

[73] Assignee: Eastman Kodak Company, Rochester, N.Y.

[21] Appl. No.: 807,337

[22] Filed: Dec. 16, 1991

[51] Int. Cl.[5] ..... G03G 15/14

[52] U.S. Cl. ..... 355/271; 355/212

[58] Field of Search ..... 355/271, 212, 273, 200, 355/77

[56] References Cited

U.S. PATENT DOCUMENTS

| | | | |
|---|---|---|---|
| 4,739,361 | 4/1988 | Roy et al. | 355/277 |
| 4,862,211 | 8/1989 | Kutami et al. | 355/212 |
| 4,884,105 | 11/1989 | Joseph et al. | 355/212 |
| 4,961,089 | 10/1990 | Jamzadeh | 355/212 X |
| 5,070,365 | 12/1991 | Agarwal | 355/212 |

*Primary Examiner*—A. T. Grimley
*Assistant Examiner*—Sandra L. Brasé
*Attorney, Agent, or Firm*—Lawrence P. Kessler

[57] ABSTRACT

An improved transfer apparatus for use for example in an electrostatographic reproduction device wherein marking particle images are transferred from a moving transferable image support by a transfer member as the transfer member moves in contact with the support. The improved transfer apparatus includes a drive for moving the transfer member at a predetermined speed substantially in timed relation with movement of the transferable image support. A mechanism, located between the transfer member and the drive, accommodates for any mismatch in speeds of the transfer member and the support at the area of contact therebetween. A member, located in that portion of the transfer member outside of the image transfer area, facilitates relative movement between the transfer member and the support during the period of time when the facilitating member is in intimate contact with the support, whereby the transfer member is substantially decoupled from the transferable image support such that any force buildup due to speed mismatch is relieved to enable registration between the transfer member and the support to be periodically reset.

16 Claims, 3 Drawing Sheets

TRANSFER APPARATUS

BACKGROUND OF THE INVENTION

This invention relates in general to a transfer apparatus for use for example in an electrostatographic reproduction device, and more particularly to an improved transfer apparatus including a mechanism for periodically resetting registration between a transfer member and a transferable image support.

In typical electrostatographic reproduction devices (copiers or copier/duplicators), pigmented marking particles are attracted to a latent image charge pattern formed on a support to develop a transferable image on the support. The transferable image support is then brought into contact with a receiver member and an electric field applied to transfer the marking particle developed image to the receiver member from the support. After transfer, the receiver member bearing the transferred image is transported away from the support and the image is fixed to the receiver member by heat and/or pressure to form a permanent reproduction thereon.

One mechanism for application of the electric field to effect marking particle image transfer from the transferable image support to the receiver member is to support the receiver member on an electrically biased roller. The roller is located in contact with the transferable image support and rotated such that the peripheral surface of the roller and the support move substantially together in registration through the area of contact (see for example U.S. Pat. No. 4,739,361, issued Apr. 19, 1988, in the names of Roy et al). In this manner the receiver member is held in transfer relation with the support to enable accurate image transfer to take place. Such roller transfer apparatus offer a distinct advantage in that it maintains a positive (physical) control over the receiver member. This positive control is particularly desirable when a receiver member must be recirculated to have multiple marking particle images sequentially transferred thereto, such as in making multi-color or composite reproductions.

While roller transfer apparatus of the above described type are generally effectively utilized in electrostatographic reproduction devices, registration particularly between sequentially transferred marking particle images is sometimes hard to accurately maintain. Particularly, under certain environmental conditions, and due to ordinary engineering tolerance requirements, the peripheral speed of the transfer roller does not match the speed of movement of the transferable image support. This can cause undesirable forces to be built up in the transfer nip, with ultimate misregistration between subsequently transferred marking particle images. Additionally, the transfer roller may be oriented at some angle relative to the plane of the transferable image support. As such, a force may be imparted to the support to cause the support to move in a cross-track direction with respect to the transfer roller.

SUMMARY OF THE INVENTION

This invention is directed to an improved transfer apparatus for use for example in an electrostatographic reproduction device wherein marking particle images are transferred from a moving transferable image support by a transfer member as the transfer member moves in contact with the support. The improved transfer apparatus includes a drive for moving the transfer member at a predetermined speed substantially in timed relation with movement of the transferable image support. A mechanism, located between the transfer member and the drive, accommodates for any mismatch in speeds of the transfer member and the transferable image support at the area of contact therebetween. A member, located in that portion of the transfer member outside of the image transfer area, facilitates relative movement between the transfer member and the transferable image support during the period of time when the facilitating member is in intimate contact with the support, whereby the transfer member is substantially decoupled from the support such that any force buildup due to speed mismatch is relieved to enable registration between the transfer member and the support to be periodically reset.

As a further aspect of this invention, when marking particle images are transferred sequentially from the transferable image support to a receiver member supported by a substantially cylindrical transfer roller over a portion of the peripheral circumference thereof as the transfer roller moves about its longitudinal axis in contact with the transferable image support, the improved transfer apparatus, for assuring registration between marking particle images and a receiver member on the transfer roller, includes a drive for rotating the transfer roller about its longitudinal axis at a predetermined angular velocity substantially in timed relation with movement of the transferable image support. A mechanism, located between the transfer roller and the drive, accommodates for any mismatch in angular velocity of the transfer roller and peripheral speed of the transferable image support at the area of contact therebetween. A member, located in that portion of the peripheral circumference of the transfer roller not serving to support a receiver member, facilitates relative movement between the transfer roller and the transferable image support during the period of time when the facilitating member is in intimate contact with the transferable image support, whereby the transfer roller is substantially decoupled from the support such that any force buildup due to speed mismatch is relieved to enable registration between the transfer roller and the support to be periodically reset.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
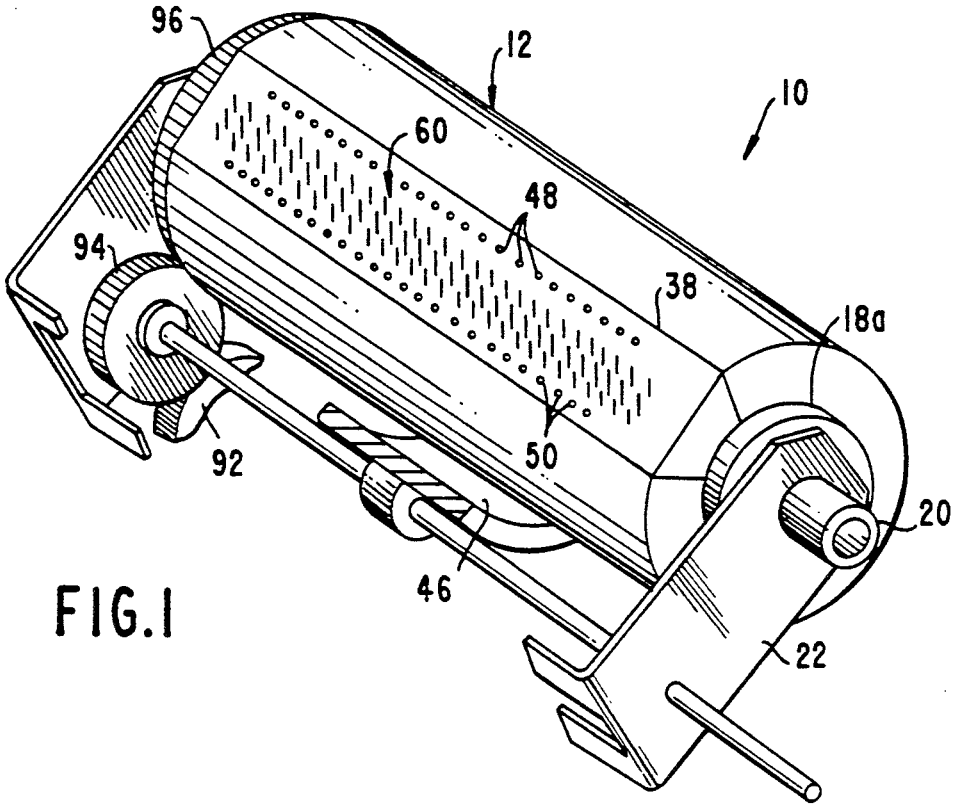
FIG. 1 is a view, in perspective, of the improved transfer apparatus according to this invention.
Figure 2:
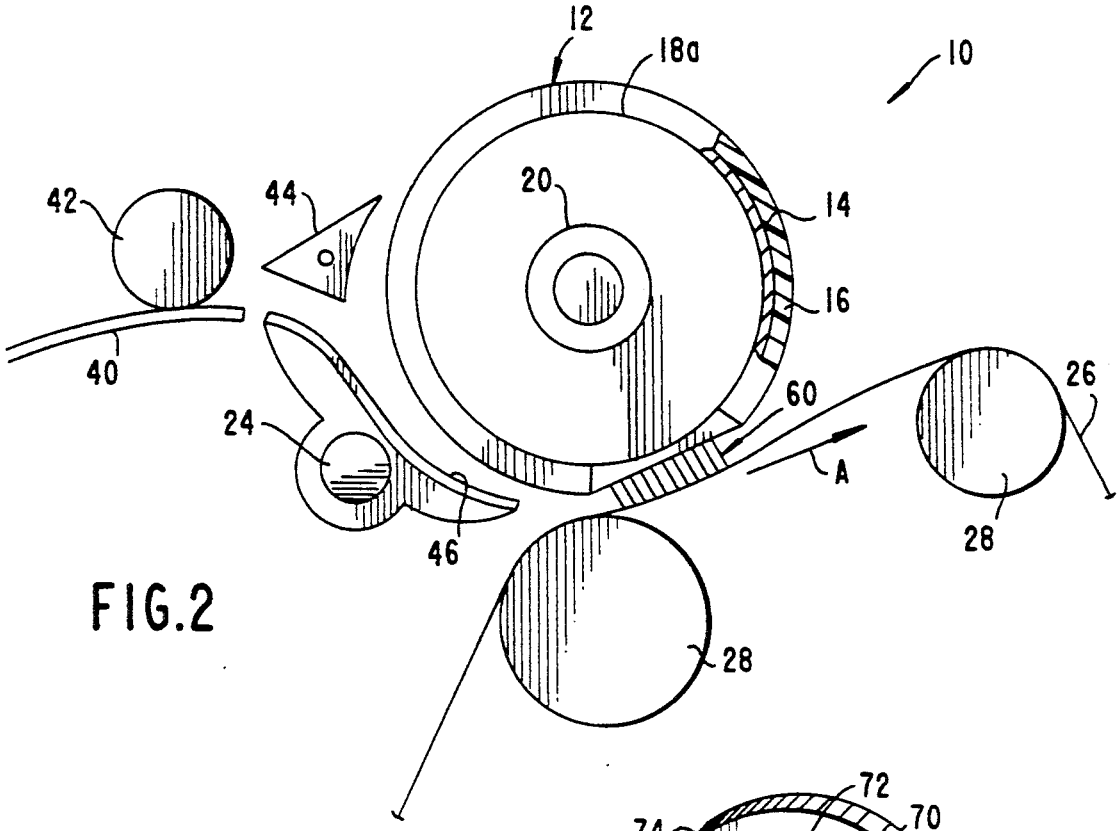
FIG. 2 is an end elevational view of the improved transfer apparatus of FIG. 1, with the transfer roller thereof in operative relation with a transferable image support, with portions removed to facilitate viewing.

Referring now to the accompanying drawings, FIGS. 1 and 2 show a transfer apparatus, incorporating the improvement according to this invention, designated generally by the numeral 10. The transfer apparatus 10 may for example be generally of the type fully described in the aforementioned U.S. Pat. No. 4,739,361, although other transfer apparatus such as donor transfer roller and web arrangements are suitable for use with this invention (donor transfer as used herein refers to transfer of marking particle images directly to the transfer roller or web with subsequent transfer to a receiver member).

The exemplary transfer apparatus 10 includes a substantially cylindrical roller 12 comprising a conductive core 14 having a surface layer 16 formed thereon. The surface layer 16, which may be of an insulating, semi-insulating, or conductive material for example, is tailored to yield optimum production of an electric transfer field for effecting transfer of a pigmented marking particle image from a transferable image support to a receiver member supported on such surface layer (or the surface layer per se). The core 14 is coupled to end gudgeons 18*a*, 18*b* which have integrally formed stub shafts 20 (only one shown in FIG. 1) extending therefrom coaxially with the longitudinal axis of the roller 12. The shafts 20 are mounted in a frame 22 for free rotation about their longitudinal axes.

The frame 22 is located to position the roller 12 with the peripheral surface layer 16 of the roller in operative transfer association with a transferable image support 26 (e.g., a continuous loop dielectric web). The support 26, supported for movement in the direction of arrow A about rollers 28, is adapted to carry electrostatically developed transferable pigmented marking particle images in sequentially spaced image receiving areas of the member. Formation of such transferable images in the image areas of the support 26 may be accomplished by any well known technique, such as electrophotographically for example. With an electrical transfer field applied between the roller 12 and the transferable image support 26, the marking particle images are transferred from the support to a receiver member supported on the peripheral surface of the roller 12 (or, in the example of a donor transfer roller or web arrangement, directly to the donor transfer roller or web).

In order to carry out accurate transfer of pigmented marking particle images to receiver members, a receiver member must be accurately located on the peripheral surface of the transfer roller 12, and the angular position of the roller (and the receiver member located thereon) must be accurately related to the location of the marking particle image on the transferable image support. Such accurate location is especially necessary when a plurality of marking particle images are to be sequentially transferred in superimposed register, as in forming a multi-color or composite reproduction.

A receiver member is transported toward the transfer apparatus 10 along a guide plate 40 by any well known transport mechanism, such as rotating scuff rollers 42. A deflector 44 and a guide 46, for example, cooperate to direct the lead edge of a transported receiver member into engagement with the transfer roller 12 upstream of the transfer zone formed by the nip between the transfer roller and the transferable image support 26. The transport of the receiver member is timed with the angular position of the transfer roller 12 such that the receiver member will be captured and retained in accurate location on the peripheral surface 16 of the transfer roller by vacuum tacking of the lead and trail edges of such receiver member to the peripheral surface. To effect such vacuum tacking, the transfer roller 12 includes a first series of ports 48 and a second series of ports 50. The first series of ports 48 is defined by and extends through an insert piece 38 along a first segment of the transfer roller 12, and the second series of ports 50 is defined by and extends through the insert piece along a second segment of the transfer roller. The insert 38 further defines a pair of elongated chambers (not shown) which are in flow communication with the first and second series of ports respectively to couple a vacuum source (not shown) thereto.

As noted above, it is essential that the angular position of the transfer roller 12 (and the receiver member located thereon) be accurately related to the location of the pigmented marking particle images on the transferable image support 26. Accordingly, the transfer roller diameter (sized to accommodate for the thickness of a receiver sheet supported on the surface of transfer roller) is selected such that the circumference is substantially equal to the distance between corresponding points in successive image areas on the support 26. That is to say, the circumference is substantially equal to the length of an image area in the direction of support travel plus the the interframe distance between successive image areas. Then the angular velocity of the transfer roller 12 is selected such that, under ideal conditions, the linear velocity of the receiver sheet on the surface 16 of the roller is substantially equal to the linear velocity of the image support 26. Further, the angular position of the transfer roller 12 is selected such that the location of the lead edge of a receiver member (vacuum tacked to roller 12 at ports 48) is in register with the lead edge of an image area as the receiver member and the image area enter the transfer (intimate contact) zone. The movement of the transfer roller and the transferable image support are synchronized to then insure accurate transfer of a marking particle image in register to the receiver member, and further, accurate transfer of successive marking particle images in superimposed register to the receiver member.

Figure 3:
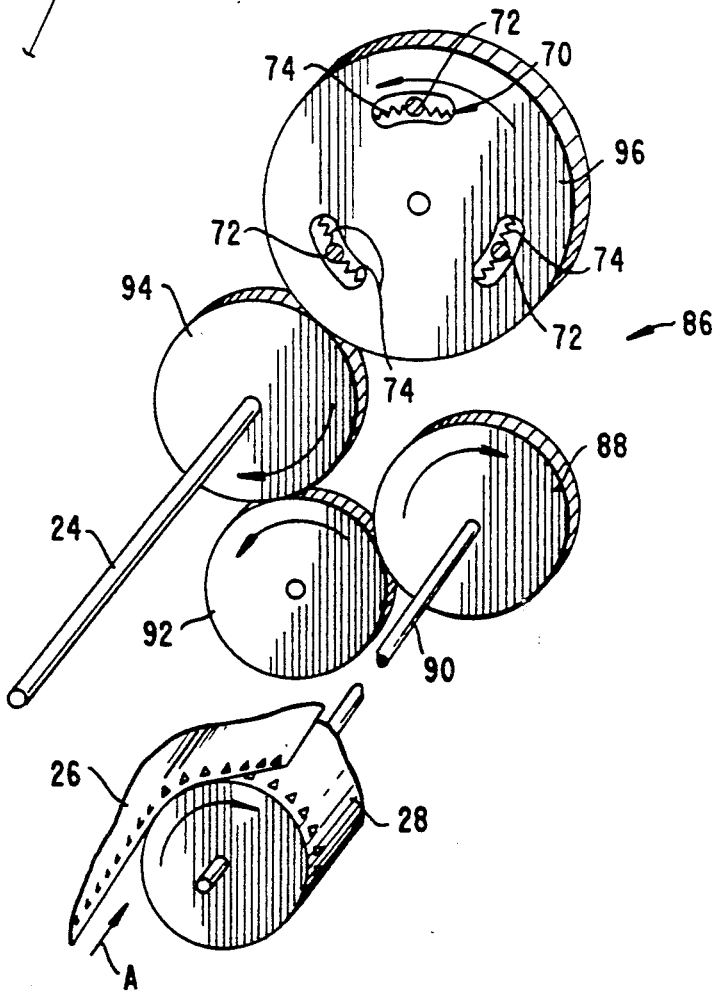
FIG. 3 is a view, in perspective, of the gear train for rotatably driving the transfer roller of the improved transfer apparatus of FIG. 1, including a mechanism for accommodating for speed mismatch between the transfer roller and the transferable image support.

In the illustrated embodiment, the synchronization of rotation of the transfer roller 12 with the movement of the transferable image support 26 is accomplished by the gear train 86 best shown in FIG. 3. The gear train 86 includes a first gear 88 mounted for rotation on the drive shaft 90 for one of the transferable image support supporting rollers 28. Such roller has its teeth in mesh with perforations along a marginal edge of the support 26 for moving the support at a predetermined linear velocity in the direction of arrow A. Therefore, the angular velocity of the gear 88 is equal to that of roller 28. The remainder of the gear train 86 includes a second gear 92 in mesh with a third gear 94, mounted for free rotation about shaft 24, in mesh with a fourth gear 96, coupled to one end gudgeon of the transfer roller 12. Thus, the drive for the transferable image support 26 is synchronously related to rotation of the transfer roller 12. The diameters and pitches of the respective gears of the gear train 86 are selected to yield substantially equal linear velocities for the peripheral surface 16 of the roller 12 and the transferable image support 26 to provide the synchronous movement therebetween.

Ideal conditions conditions for synchronizing movement of the transfer roller 12 and the transferable image support 26 are not always found to exist. For example, under certain environmental conditions the diameter of the transfer roller changes. Further, due to ordinary engineering tolerance requirements the actual diameter of the transfer roller may be somewhat different than the theoretically ideal roller diameter. As such, the peripheral speed of the transfer roller may be different than its desired speed even though the angular velocity may be precisely set. Accordingly, the peripheral speed of the transfer roller will not necessarily match the speed of movement of the image support. This can cause undesirable forces to be built up in the transfer nip, with ultimate misregistration between subsequently transferred marking particle images. Moreover, the longitudinal axis of the transfer roller 12 may be at some relative angle to the plane of the transferable image support 26. As such, a force may be imparted to the support which causes the support to move in a cross-track direction with respect to the transfer roller. This may also lead to misregistration between subsequently transferred marking particle images.

Therefore, according to this invention, in order to compensate for any speed mismatch and enable registration between the transfer roller and the image support to be maintained, the transfer apparatus includes a mechanism 70 (accommodating for any speed mismatch between the transfer roller and the transferable image support) and an alignment reset facilitating device 60. The device 60 facilitates relative movement between the transfer roller 12 and the support 26 when the device is in intimate contact with the support, whereby the transfer roller is substantially decoupled from the support such that any force buildup due to speed mismatch accommodated for by the mechanism 70 and/or misalignment is relieved to enable registration between the transfer roller and the support to be periodically reset.

The speed mismatch accommodating mechanism 70, as shown in the embodiment depicted in FIG. 3, includes a resilient drive interconnection between the gear 96 and the associated end gudgeon of the transfer roller 12. Such resilient drive interconnection comprises a plurality of pins 72 extending from the end gudgeon substantially parallel to the longitudinal axis of the transfer roller. The plurality of pins 72 are engaged by a plurality of spring sets 74 respectively, such spring sets being carried by the gear 96. The spring sets act on the respective pins to transmit the rotational movement of the gear 96 to the transfer roller 12 such that under ideal conditions the angular velocity of the transfer roller would be equal to the angular velocity of the gear.

During transfer, however, the movement of the transferable image support 26, in intimate contact with the transfer roller 12, attempts to rotate the transfer roller at an angular velocity determined by the linear speed of the support (i.e., an angular velocity such that the surface speed of the transfer roller matches the linear speed of the support). When conditions are such that the angular velocity imparted to the transfer roller by the support 26 and the velocity imparted to the transfer roller through the resilient drive interconnection are equal, the spring sets 74 acting on the respective pins 72 are balanced and the transfer roller will rotate in synchronism with the gear 96, with the forces in the transfer nip considered to be balanced. On the other hand, if such angular velocities are not equal, relative movement between the transfer roller 12 and the gear 96 in the rotational direction is enabled by compression of corresponding springs in each of the spring sets 74. While this accommodates for speed mismatch, allowing the surface speed of the transfer roller to match the linear speed of the support, the forces in the transfer nip become unbalanced and the registration between the transfer roller and the support are adversely effected.

Accordingly, the reset facilitating device 60 is utilized to periodically relieve the force imbalance (buildup) and reset the registration between the transfer roller and the transferable image support. The reset facilitating device 60 comprises a fibrous material 62 secured to the insert 38. The material 62 is, for example, a nylon felt or plush having nonconductive self-cleaning fibers. The individual fibers 64 extend substantially radially from a base 66 a distance slightly greater than the distance between the insert 38 and the transferable image support 26 when the insert is in direct proximity to the support. The fibers are selected to be of a density and strength sufficient to engage the support 26 without any appreciable bending of the fibers in the longitudinal direction. As such, the individual fibers may be viewed as being a multiplicity of cantilever beams which exhibit considerable strength along the longitudinal axis but are readily bent in any direction transverse to the longitudinal axis (i.e., the free end of a fiber is movable about the point of attachment of its opposite end to the base). As an illustrative example, the fibers may be made of nylon of a diameter of approximately 0.12 mm, and a fiber density of approximately approximately 1,900 fibers per square inch.

Figure 4:
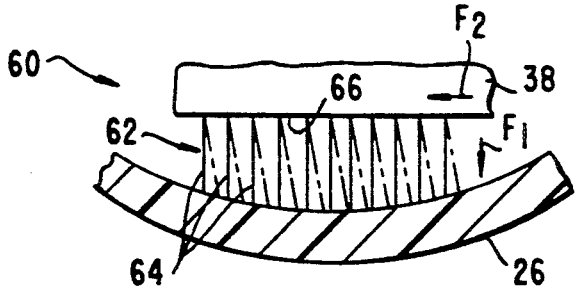
FIG. 4 is an end elevational view, on an enlarged scale, of a portion of the improved transfer apparatus according to this invention, particularly showing the engagement of the device for facilitating relative movement between the transfer roller and the transferable image support.

Accordingly, when the device 60 is in its position proximate the support 26, the fibers act to push on the support with sufficient force $F_1$ to space the support from the transfer roller (see FIG. 4). The spacing force is not so great as to induce a potentially defect-producing wave in the support or scratch the support. This, in effect, decouples the transfer roller from the transferable image support. While the transfer roller 12 is spaced from the transferable image support 26, the force buildup in the nip (stored in the compressed springs of the spring sets 74), acts (as the force $F_2$) to bend the fibers 64 enabling the transfer roller to move relative to the support. In this manner, the force buildup is substantially relieved and the registration between the transfer roller and the support is reset. Further, any forces (normal to the force $F_2$) tending to induce cross-track misalignment are also similarly relieved. Since this relieving/resetting action occurs every time the device 60 is in proximity to the support (during every revolution of the transfer roller),. substantial force buildup is prevented and accurate registration is accomplished.

Figure 5:
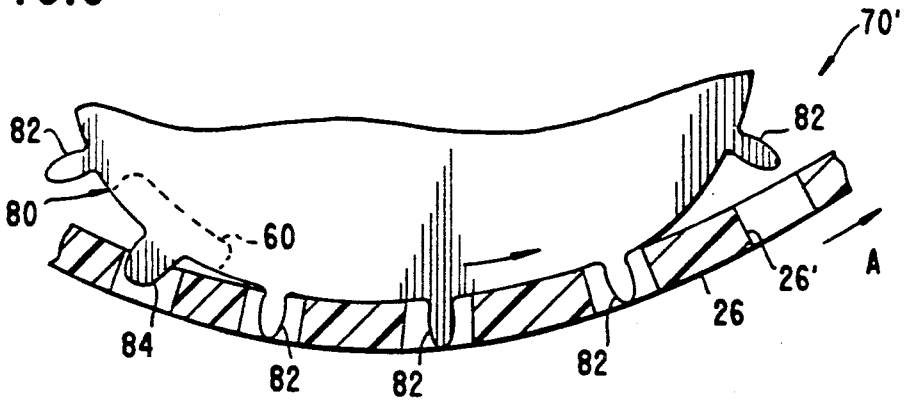
FIG. 5 is an end elevational view, on an enlarged scale and with portions removed to facilitate viewing, of an alternate embodiment of the mechanism for accommodating for speed mismatch between the transfer roller and the transferable image support of the improved transfer apparatus according to this invention.

An alternate embodiment for the speed mismatch accommodating device, designated by the numeral 70' is shown in FIG. 5. The device 70', replacing the gear train 86 of FIG. 3, incorporates a sprocket 80 coupled to an associated end gudgeon of the transfer roller 12. The sprocket 80 includes a series of teeth 82, each tooth of such series being of one particular dimensional profile, and one tooth 84 of a substantially larger dimensional profile. The sprocket 80 is located such that the teeth 82 and 84 are receivable in perforations 26' of the transferable image support 26. The dimension of each perforation 26' is substantially larger than the cross-section of one of the teeth 82, and only slightly larger than the cross-section of the tooth 84. Further, the tooth 84 is aligned with the reset facilitating device 60.

With the above described arrangement, movement of the transferable image support 26 normally effects rotation of the transfer roller 12 through a friction drive due to its wrap with the transfer roller. The teeth 82 of the sprocket 80 are respectively received in the perforations 26' of the support as the transfer roller 12 (and sprocket 80) is rotated. However due to their undersizing, the teeth are free to move within the perforations when there is any relative motion (speed mismatch) between the transfer roller and the support. Such relative motion may be caused for example by changes in the frictional characteristics due to marking particles in the transfer nip. When the angular position of the transfer roller 12 is such that the reset facilitating device 60 is in contact with the transferable image support 26, the transfer roller is, in effect, decoupled from the support as described above. During such decoupling, the tooth 84 enters a perforation 26'. If the transfer roller 12 and the support 26 have moved relatively so as to alter registration therebetween, the tooth 84 will engage a side wall of the perforation and, because of the decoupling, move the transfer roller relative to the support back into register therewith. Since this resetting action occurs every time the device 60 is in contact with the support (between every image transfer), every image transfer is in proper registration.

Figure 6:
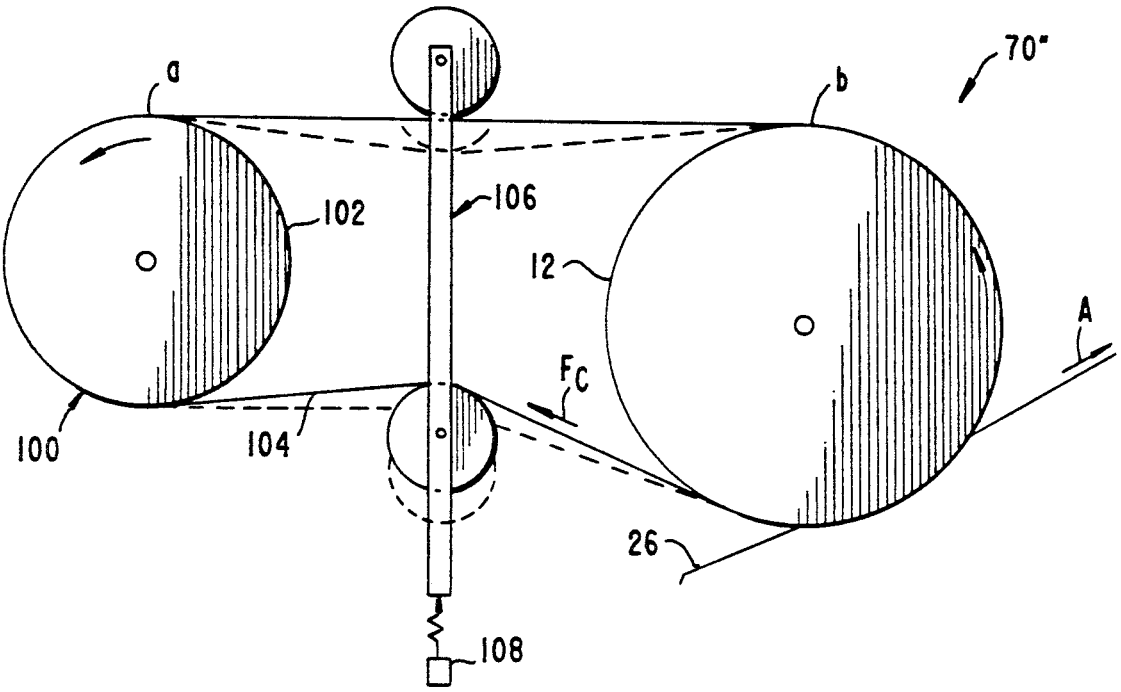
FIG. 6 is an end elevational view, with portions removed to facilitate viewing, of another alternate embodiment of the mechanism for accommodating for speed mismatch between the transfer roller and the transferable image support of the improved transfer apparatus according to this invention.

Another alternate embodiment for the speed mismatch accommodating device, designated by the numeral 70'' is shown in FIG. 6. The device 70'', replacing the gear train 86, incorporates another type of a mechanical drive assembly 100 for rotating the transfer roller 12. The drive assembly 100 includes a gear 102 rotatably driven by a motor (not shown). The motor may be, for example, the main drive for the transferable image support 26. A closed loop belt 104, with a tensioning device 106, transmits rotation of the gear 102 to the transfer roller (through a chain and sprocket or belt and pulley type arrangement). The diameter of the transfer roller is selected to be slightly smaller than would be required to exactly match the peripheral speed of the transfer roller to the peripheral speed of the support. Further, the gear 102 is spaced from the transfer roller a predetermined distance such that the length of the run of the belt 104 between the gear and the transfer roller lying along a line extending between the points (designated in FIG. 6 as "a" and "b") respectively tangent to the gear and the transfer roller is equal to the pitch between image areas on the support 26.

When the transfer roller 12 is frictionally driven by the transferable image support 26, due to the selected diameter of the transfer roller, its angular velocity is always slightly greater than it would be if driven only by the belt 104. As such the transfer roller is over driven, effecting a tightening of the belt run from the gear 102 to the transfer roller (the lower run in FIG. 6), and a slackening of the belt run from the transfer roller to the gear (the upper run in FIG. 6). Such condition is shown in phantom in FIG. 6. At the time the reset facilitating device 60 is in contact with the transferable image support 26, as described above the transfer roller is decoupled from the support. During the time in which decoupling is effective, the tensioning device 106 is moved (such as by a solenoid 108 for example) to apply a correction force to the lower run of the belt 104. The correction force $F_c$ rotates the transfer roller in the direction (counterclockwise in FIG. 6) until the upper run is tight; that is, the upper run of the belt lies along the aforementioned tangent line. Such condition is shown in solid lines in FIG. 6. Since the tangent line is equal to the pitch between image areas on the support, tightening of the upper belt run resets the transfer roller relative to the support such that the transfer roller is back in registration with the support. Again, since this occurs every time the device 60 is in contact with the support (between every image transfer), every image transfer is in proper registration.

The invention has been described in detail with particular reference to preferred embodiments thereof, but it will be understood that variations and modifications can be effected within the spirit and scope of the invention.

I claim:

1. In an electrostatographic reproduction device wherein marking particle images are transferred from a moving transferable image support by a transfer member as said transfer member moves in contact with said support, an improved transfer apparatus for assuring registration between marking particle images and said transfer member, said improved transfer apparatus comprising:

means for driving said transfer member at a predetermined speed substantially in timed relation with movement of said transferable image support;

means, located between said transfer member and said drive means, for accommodating for any mismatch in speeds of said transfer member and said transferable image support at the area of contact therebetween; and means, located in that portion of said transfer member outside of the image transfer area, for facilitating relative movement between said transfer member and said transferable image support during the period of time when said facilitating means is in intimate contact with said support, whereby said transfer member is substantially decoupled from said transferable image support such that any force buildup due to speed mismatch and/or misalignment is relieved to enable registration between said transfer member and said support to be periodically reset.

2. The improved transfer apparatus of claim 1 wherein said driving means includes a gear train including a plurality of intermeshing gears, the first gear of said gear train receiving input from said transferable image support and the last gear of said gear train delivering output to said transfer member.

3. The improved transfer apparatus of claim 2 wherein said accommodating means includes resilient means for coupling said last gear of said gear train to said transfer member to enable limited relative movement therebetween.

4. The improved transfer apparatus of claim 3 wherein said resilient means includes a plurality of pins extending from said transfer member, and a plurality of spring sets, associated with said plurality of pins respectively, said spring sets being carried by said last gear of said gear train.

5. The improved transfer apparatus of claim 1 wherein said accommodating means includes a gear associated with said transfer member, said gear including a series of teeth adapted to be received respectively in perforations in said transferable image support, each tooth of said series of teeth being of a cross-sectional dimension substantially smaller than one of said perforations, and a single tooth adapted to be received in said perforations in said transferable image support and aligned with said means for facilitating relative movement between said transfer member and said transferable image support, said single tooth being of a cross-sectional dimension only slightly smaller than one of said perforations, whereby said single tooth is engageable with a side wall of one of said perforations when received therein to move said transfer member relative to said support when said facilitating means is in contact with said support means.

6. The improved transfer apparatus of claim 1 wherein said accommodating means includes a belt drive having a belt associated with said transfer member for moving said transfer member, and a belt tensioning device, and means for actuating said tensioning device to move said belt and thus said transfer member, whereby said transfer member is moved relative to said support when said facilitating means is in contact with said support means.

7. The improved transfer apparatus of claim 1 wherein said means for facilitating relative movement between said transfer member and said transferable image support includes a plurality of fibers extending substantially outwardly from said transfer member so as to engage said transferable image support at the tips of said fibers when said facilitating means is in proximity to said support.

8. The improved transfer apparatus of claim 7 wherein said fibers are selected to have substantial strength in the direction along their respective longitudinal axes and are relatively flexible in any direction perpendicular to their respective longitudinal axes.

9. The improved transfer apparatus of claim 8 wherein said fibers are selected to have a respective length sufficient to move said transferable image support away from said transfer member on engagement of said fibers with said support.

10. In an electrostatographic reproduction device wherein marking particle images are transferred from a moving image support to a receiver member supported by a transfer roller over a portion of the peripheral circumference thereof as said transfer roller moves in contact with said support, an improved transfer apparatus for assuring registration between marking particle images and a receiver member on said transfer roller, said improved transfer apparatus comprising:

means for rotating said transfer roller at a predetermined angular velocity substantially in timed relation with movement of said support;

means, located between said transfer roller and said rotating means, for accommodating for any mismatch in angular velocity of said transfer roller and peripheral speed of said support at the area of contact therebetween; and means, located in that portion of the peripheral circumference of said transfer roller not serving to support a receiver member, for facilitating relative movement between said transfer roller and said support during the period of time when said means is in intimate contact with said support, whereby said transfer roller is substantially decoupled from said transferable image support such that any force buildup due to speed mismatch and/or misalignment is relieved to enable registration between said transfer roller and said support to be periodically reset.

11. The improved transfer apparatus of claim 10 wherein said means for facilitating relative movement between said transfer member and said transferable image support includes a plurality of fibers extending substantially outwardly from said transfer member so as to engage said transferable image support at the tips of said fibers when said facilitating means is in proximity to said support.

12. The improved transfer apparatus of claim 11 wherein said fibers are selected to have substantial strength in the direction along their respective longitudinal axes and are relatively flexible in any direction perpendicular to their respective longitudinal axes.

13. The improved transfer apparatus of claim 12 wherein said fibers are selected to have a respective length sufficient to move said transferable image support away from said transfer member on engagement of said fibers with said support.

14. Apparatus for transferring a plurality of marking particle images from a moving transferable image support in registration to a receiving surface, said apparatus comprising:

a rotatable transfer member having an outer surface including an image transfer portion and an interframe portion;

drive means for rotating said transfer member to move said receiving surface through transfer relation with said moving transferable image support at substantially the same speed as said support;

means for coupling said drive means and said transfer member to permit overriding of said drive means by frictional driving of said transfer member by said support; and means associated with the interframe portion of said transfer member for permitting reindexing of said transfer member with respect to said drive means when said interframe portion faces said transferable image support.

15. The invention of claim 14 wherein said coupling means includes resilient means for reindexing said first drive when said interframe portion faces said transferable image support.

16. In an electrostatographic reproduction device wherein marking particle images are transferred from a moving transferable image support by a transfer member as said transfer member moves in contact with said support, an improved method of transfer for assuring registration between marking particle images and said transfer member, said improved transfer method comprising the steps of:

driving said transfer member at a predetermined speed substantially in timed relation with movement of said support;

accommodating for any mismatch in speeds of said transfer member and said support at the area of contact therebetween; and facilitating relative movement between said transfer member and said support during the period of time when an interframe between images to be transferred is in intimate contact with said support, whereby the transfer member is substantially decoupled from the transferable image support such that any force buildup due to speed mismatch and/or misalignment is relieved to enable registration between the transfer roller and the support to be periodically reset.

* * * * *